US010066855B2

(12) United States Patent
Xu et al.

(10) Patent No.: US 10,066,855 B2
(45) Date of Patent: Sep. 4, 2018

(54) PULSE TUBE REFRIGERATOR

(71) Applicant: SUMITOMO HEAVY INDUSTRIES, LTD., Tokyo (JP)

(72) Inventors: Mingyao Xu, Tokyo (JP); Hirokazu Takayama, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 459 days.

(21) Appl. No.: 14/183,815

(22) Filed: Feb. 19, 2014

(65) Prior Publication Data

US 2014/0250920 A1 Sep. 11, 2014

(30) Foreign Application Priority Data

Mar. 5, 2013 (JP) ..... 2013-043292

(51) Int. Cl.
*F25B 9/00* (2006.01)
*F25B 9/14* (2006.01)
*F25B 9/10* (2006.01)

(52) U.S. Cl.
CPC ..... *F25B 9/145* (2013.01); *F25B 9/10* (2013.01); *F25B 2309/1408* (2013.01); *F25B 2309/1413* (2013.01); *F25B 2309/1418* (2013.01)

(58) Field of Classification Search
CPC ..... F25B 9/145; F25B 2309/1425; F25B 2309/1418; F25B 2309/1411; F25B 2309/1412; F25B 2309/1414; F25B 2309/1415; F25B 2309/1416; F25B 2309/1421; F25B 2309/1427; F25B 9/10
See application file for complete search history.

(56) References Cited

U.S. PATENT DOCUMENTS

| | | | | |
|---|---|---|---|---|
| 6,343,475 B1 * | 2/2002 | Ishikawa | F25B 9/145 62/6 |
| 2002/0152758 A1 * | 10/2002 | Longsworth | F25B 9/145 62/6 |
| 2011/0173995 A1 * | 7/2011 | Takayama | F25B 9/145 62/6 |

FOREIGN PATENT DOCUMENTS

| | | |
|---|---|---|
| JP | H09-229502 | 9/1997 |
| JP | 2009-264595 | 11/2009 |
| JP | 2011-094835 | 5/2011 |
| JP | 2011-149601 | 8/2011 |

* cited by examiner

*Primary Examiner* — Frantz Jules
*Assistant Examiner* — Erik Mendoza-Wilkenfe
(74) *Attorney, Agent, or Firm* — IPUSA, PLLC

(57) ABSTRACT

A pulse tube refrigerator includes a compressor, a regenerator to which a refrigerant gas is discharged from the compressor and from which the refrigerant gas returns to the compressor, a pulse cube including a low-temperature end connected to the low-temperature end of the regenerator, and a flow rate controller provided at the low-temperature end of the regenerator. The flow rate controller is configured to control the flow rate of a first DC flow flowing from the regenerator toward the pulse tube and the flow rate of a second DC flow flowing from the pulse tube toward the regenerator, so that the flow rate of the first DC flow is greater than the flow rate of the second DC flow.

9 Claims, 5 Drawing Sheets

PULSE TUBE REFRIGERATOR

CROSS-REFERENCE TO RELATED APPLICATION

This application is based upon and claims the benefit of priority of Japanese Patent Application No. 2013-043292, filed on Mar. 5, 2013, the entire contents of which are incorporated herein by reference.

BACKGROUND

Technical Field

The present invention relates to pulse tube refrigerators with an improved cooling capability.

Description of Related Art

Pulse tube refrigerators have been known as refrigerators capable of producing low temperatures with reduced vibrations. False tube refrigerators include a compressor, a valve unit, a regenerator, a pulse tube connected to the regenerator, a buffer orifice connected to the pulse tube, and a buffer tank. A refrigerant gas (for example, helium gas) is taken in from and discharged to the regenerator and the pulse tube with predetermined timing.

Cooling is generated at the low-temperature side of the pulse tube by suitably controlling the phase difference between the pressure variation and the displacement of the refrigerant gas inside the pulse tube.

SUMMARY

According to an aspect of the present invention, a pulse tube refrigerator includes a compressor, a regenerator to which a refrigerant gas is discharged from the compressor and from which the refrigerant gas returns to the compressor, a pulse tube including a low-temperature end connected to the low-temperature end of the regenerator, and a flow rate controller provided at the low-temperature end of the regenerator. The flow rate controller is configured to control the flow rate of a first DC flow flowing from the regenerator toward the pulse tube and the flow rate of a second DC flow flowing from the pulse tube toward the regenerator, so that the flow rate of the first DC flow is greater than the flow rate of the second DC flow.

It is to be understood that both the foregoing general description and the following detailed description are exemplary and explanatory and not restrictive of the invention.

DETAILED DESCRIPTION

Unlike Gifford-McMahon refrigerators (GM refrigerators) or Stirling refrigerators, pulse tube refrigerators are not provided with a displacer that forcibly generates a flow in the refrigerant gas.

Therefore, when the refrigerant gas (for example, helium gas) is taken in from, or discharged to the regenerator and the pulse tube with predetermined timing, a circulating flow called "DC flow" may be generated inside the regenerator, inside the pulse tube, and between the regenerator and the pulse tube.

When this circulating flow flows from the high-temperature end side to the low-temperature end side of the pulse tube or flows from the pulse tube to the regenerator, the cooling performance may be reduced by an increase in heat that enters the low-temperature end side from the high-temperature end side.

According to an aspect of the present invention, a pulse tube refrigerator whose cooling performance is improved by controlling the flow of a DC flow is provided.

According to an aspect of the present invention, a DC flow that flows from the low-temperature side to the high-temperature side in a pulse tube is generated by an increase in the flow rate of a DC flow flowing from a regenerator to the pulse tube. Therefore, the temperature distribution inside the pulse tube is improved, so that it is possible to improve a cooling capability.

A description is given below, with reference to the accompanying drawings, of embodiments of the present invention.

Figure 1:
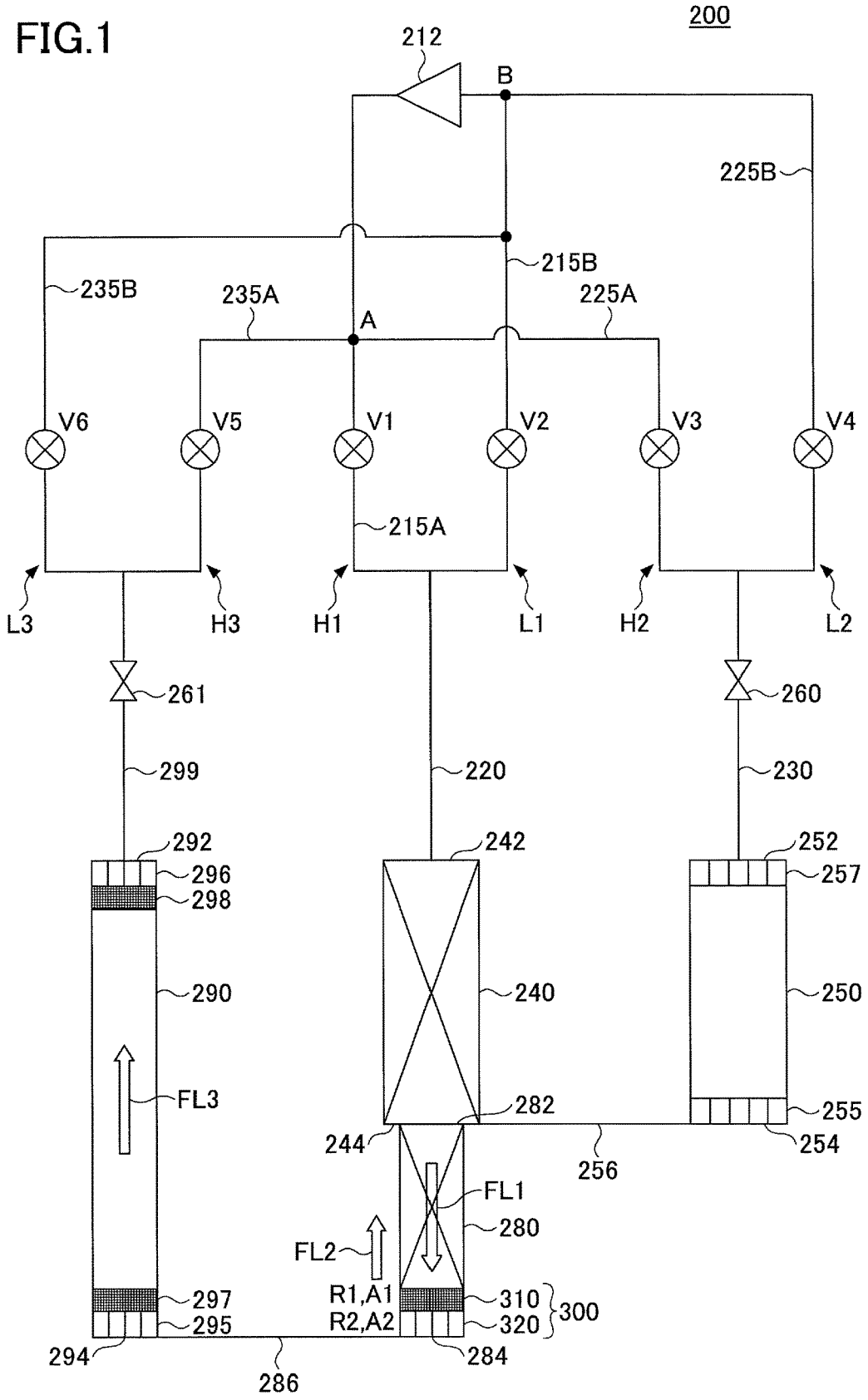
FIG. 1 is a schematic diagram illustrating a configuration of a pulse tube refrigerator that is an embodiment of the present invention.

FIG. 1 is a diagram illustrating a pulse tube refrigerator 200, which is an embodiment of the present invention. By way of example, a two-stage four-valve pulse tube refrigerator is illustrated as the pulse tube refrigerator 200 illustrated in FIG. 1.

As illustrated in FIG. 1, the pulse tube refrigerator 200 includes a compressor 212, a first-stage regenerator 240, a second-stage regenerator 280, a first-stage pulse tube 250, a second-stage pulse tube 290, a first pipe 256, a second pipe 286, channel resistances 260 and 261 each including an orifice, and opening and closing valves V1, V2, V3, V4, V5 and V6.

The first-stage regenerator 240 includes a high-temperature end 242 and a low-temperature end 244. The second-stage regenerator 280 also includes a high-temperature end 282 and a low-temperature end 284. The low-temperature end 244 of the first-stage regenerator 240 and the high-temperature end 282 of the second-stage regenerator 280 are connected, so that the first-stage regenerator 240 and the second-stage regenerator 280 are integrated.

Furthermore, a first flow rate controller 300 is provided on the low-temperature end side of the second-stage regenerator 280. For convenience of description, this first flow rate controller 300 is described below.

The first-stage pulse tube 250 has a high-temperature-side heat exchanger 257 provided at a high-temperature end 252 and has a low-temperature-side neat exchanger 255 provided at a low-temperature end 254. Furthermore, the second-stage pulse tube 290 has a high-temperature-side heat exchanger 296 and a high-temperature-side flow smoother 298 provided at a high-temperature end 292 and has a low-temperature-side heat exchanger 295 and a low-temperature-side flow smoother 297 provided at a low-temperature end 294.

Furthermore, the low-temperature end 244 of the first-stage regenerator 240 is connected to the low-temperature end 254 of the first-stage pulse tube 250 through the first pipe 256. Furthermore, the low-temperature end 284 of the second-stage regenerator 280 is connected to the low-temperature end 294 of the second-stage pulse tube 290 through the second pipe 286.

A refrigerant channel on the high-pressure side (discharge side) of the compressor 212 branches into three directions at a point A, so that first, second and third refrigerant supply channels H1, H2 and H3 are formed.

The first refrigerant supply channel H1 extends from the high-pressure side of the compressor 212 to the first-stage regenerator 240 via a first high-pressure-side pipe 215A, provided with the opening and closing valve V1, and a common pipe 220. Furthermore, the second refrigerant supply channel H2 extends from the high-pressure side of the compressor 212 to the first-stage pulse tube 250 via a second high-pressure-side Pipe 225A, provided with the opening and closing valve V3, and a common pipe 230, provided with the channel resistance 260. Furthermore, the third refrigerant supply channel H3 extends from the high-pressure side of the compressor 212 to the second-stage pulse tube 250 via a third high-pressure-side pipe 235A, provided with the opening and closing valve V5, and a common pipe 299, provided with the channel, resistance 261.

On the other hand, a refrigerant channel on the low-pressure side (suction side) of the compressor 212 branches into first, second and third refrigerant return channels L1, L2 and L3.

The first refrigerant return channel L1 is formed of a channel extending from the first-stage regenerator 240 to the compressor 212 via the common pipe 220, a first low-pressure-side pipe 215B, provided with the opening and closing valve V2, and a point B. Furthermore, the second refrigerant return channel L2 is formed of a channel extending from, the first-stage pulse tube 250 to the compressor 212 via the common pipe 230, provided with the channel resistance 260, a second low-pressure-side pipe 225B, provided with the opening and closing valve V4, and the point B. Furthermore, the third refrigerant return channel L3 is formed of a channel extending from the second-stage pulse tube 290 to the compressor 212 via the common pipe 299, provided with the channel resistance 261, a third low-pressure-side pipe 235B, provided with the opening and closing valve V6, and the point B.

Figure 2:
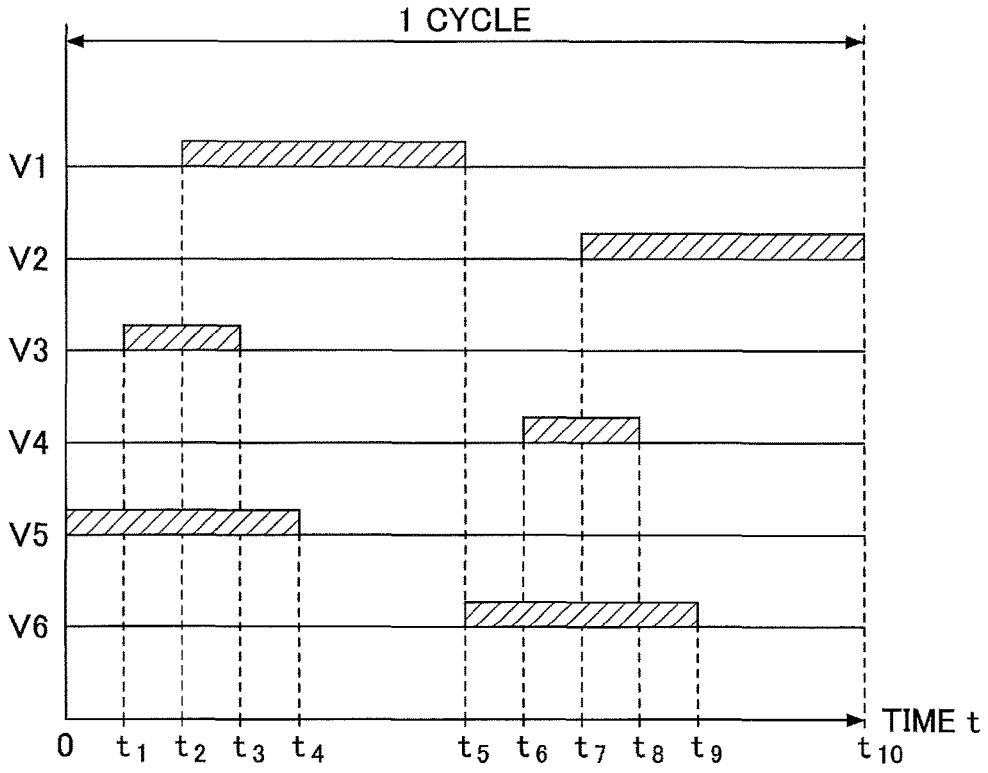
FIG. 2 is a diagram for describing valve operations of the pulse tube refrigerator that is an embodiment of the present invention.

Next, a description is given of an operation of the pulse tube refrigerator 200. FIG. 2 is a diagram for describing an operation of the pulse tube refrigerator 200, illustrating the open/closed states of the six opening and closing valves V1 through V6 provided in the pulse tube refrigerator 200 in chronological order. When the pulse tube refrigerator 200 is in operation, the open/closed states of the six opening and closing valves V1 through V6 periodically change as illustrated in FIG. 2.

First, at time 0, the opening and closing valve V5 alone is opened. As a result, a high-pressure refrigerant gas is supplied from the compressor 212 to the second-stage pulse tube 290 through the third refrigerant supply channel H3, that is, via the third high-pressure-side pipe 235A, the common pipe 299, and the high-temperature end 292.

Thereafter, at time t1, the opening and closing valve V3 is opened while the opening and closing valve V5 is kept open. As a result, a high-pressure refrigerant gas is supplied, from, the compressor 212 to the first-stage pulse tube 250 through the second, refrigerant supply channel H2, that is, via the second high-pressure-side pipe 225A, the common pipe 230, and the high-temperature end 252.

Next, at time t2, the opening and closing valve V1 is opened while the opening and closing valves V5 and V3 are kept open. As a result, a high-pressure refrigerant gas is introduced from the compressor 212 into the first-stage and second-stage regenerators 240 and 280 through the first refrigerant supply channel H1, that is, via the first high-pressure-side pipe 215A, the common pipe 220, and the high-temperature end 242.

Furthermore, part of the refrigerant gas flows into the first-stage pulse tube 250 from the low-temperature end 254 side through the first pipe 256. Furthermore, another part of the refrigerant gas passes through the second-stage regenerator 280 to flow into the second-stage pulse tube 290 from the low-temperature end 294 side through the second pipe 286.

Next, at time t3, the opening and closing valve V3 is closed while the opening and closing valve V1 is kept open. Thereafter, at time t4, the opening and closing valve V5 also is closed. The refrigerant gas from the compressor 212 flows into the first-stage regenerator 240 through the first refrigerant supply channel H1 alone. Thereafter, the refrigerant gas flows into the first-stage and second-stage pulse tubes 250 and 290 from the low-temperature end 254 side and the low-temperature end 294 side, respectively.

At time t5, the opening and closing valve V1 is closed. Because of an increase in the pressure of the first-stage and second-stage pulse tubes 250 and 290, the refrigerant gas inside the first-stage and second-stage pulse tubes 250 and 290 moves to a reservoir (not graphically represented) provided on the side of the high-temperature ends 252 and 292 of the first-stage and second-stage pulse tubes 250 and 290.

Furthermore, at time t5, the opening and closing valve V6 is opened, so that the refrigerant gas inside the second-stage pulse tube 290 returns to the compressor 212 through the third refrigerant return channel L3. Thereafter, at time t6, the opening and closing valve V4 is opened, so that the refrigerant gas inside the first-stage pulse tube 250 returns to the compressor 212 through the second refrigerant return channel L2. As a result, the pressure inside the first-stage and the second-stage pulse tubes 250 and 290 decreases.

Next, at time t7, the opening and closing valve V2 is opened while the opening and closing valves V6 and V4 are kept open. As a result, a large part of the refrigerant gas inside the first-stage and second-stage pulse tubes 250 and 290 and the second-stage regenerator 280 passes through the first-stage regenerator 240 to return to the compressor 212 through the first-stage refrigerant return channel L1.

Next, at time t8, the opening and closing valve V4 is closed while the opening and closing valve V2 is kept open. Thereafter, at time t9, the opening and closing valve V6 also is closed. Thereafter, at time t10, the opening and closing valve V2 is closed, so that one cycle is completed.

By repeating the above-described cycle as one cycle, cooling is generated at the low-temperature end of the first-stage pulse tube 250 and the low-temperature end 294 of the second-stage pulse tube 290, so that it is possible to cool an object of cooling.

Here, attention is drawn to the low-temperature end 284 of the second-stage regenerator 280, which is a final stage. The pulse tube refrigerator 200 according to this embodiment includes the first flow rate controller 300 provided at the low-temperature end 284 of the second-stage regenerator 280.

The first flow rate controller 300 includes a regenerator-side flow smoother 310 and a regenerator-side heat exchanger 320. The regenerator-side heat exchanger 320 is placed at a position close to the low-temperature end 284, to which the second pipe 286 is connected. The regenerator-side flow smoother 310 is provided on the high-temperature side (upper side in FIG. 1) of the regenerator-side heat exchanger 320. Furthermore, the regenerator-side flow smoother 310 and the regenerator-side heat exchanger 320 are placed in proximity to each other.

Each of the regenerator-side flow smoother 310 and the regenerator-side heat exchanger 320 includes multiple mesh members stacked in layers. Furthermore, the regenerator-side heat exchanger 320 is formed of copper in order to increase heat exchangeability. On the other hand, the regenerator-side flow smoother 310 is formed of a material other than copper (for example, stainless steel).

Furthermore, an aperture ratio A1 of the regenerator-side flow smoother 310 formed of mesh members (the ratio of the area of openings through which a refrigerant gas flows to the area of the regenerator-side flow smoother 310 in a plan view) is smaller than an aperture ratio A2 of the regenerator-side heat exchanger 320 (the ratio of the area of openings through which a refrigerant gas flows to the area of the regenerator-side heat exchanger 320 in a plan view) (A1<A2).

Specifically, while the regenerator-side heat exchanger 320 uses a coarse mesh member of 10 to 100 mesh, the regenerator-side flow smoother 310 uses a fine mesh member of 150 to 400 mesh.

As a result of configuring the first flow rate controller 300 as described above, a channel resistance per unit length R1 of the regenerator-side flow smoother 310 is greater than a channel resistance per unit length R2 of the regenerator-side heat exchanger 320 (R1>R2).

In the pulse tube refrigerator 200 including the first flow rate controller 300 configured as described above, when the opening and closing valves V1 through V6 are opened and closed with the valve timing described with reference to FIG. 2, a DC flow (circulating flow) of a refrigerant gas is generated in the first-stage and second-stage regenerators 240 and 280, the first-stage and second-stage pulse tubes 250 and 290, end the first and second pipes 256 and 286 of the pulse tube refrigerator 200.

In the case of connecting two channels that are different in channel resistance, a refrigerant gas has the characteristic of being less likely to flow from the side of a smaller channel resistance to the side of a greater channel resistance. Therefore, with an oscillatory flow of the refrigerant gas, a DC flow in the flow direction of the side of a greater channel resistance to the side of a smaller channel resistance is locally generated.

Here, attention is drawn to a refrigerant gas flow in the first flow rate controller 300. As described above, the channel resistance R1 of the regenerator-side flow smoother 310 of the first flow rate controller 300 is greater than the channel resistance R2 of the regenerator-side heat exchanger 320 (R1>R2). In other words, the channel, resistance R2 of the regenerator-side heat exchanger 320 is smaller than the channel resistance R1 of the regenerator-side flow smoother 310. Accordingly, the flow rate of a flow flowing from the second-stage regenerator 280 toward the second-stage pulse tube 290 (indicated by an arrow FL1 in FIG. 1) is greater than the flow rate of a flow flowing from the second-stage pulse tube 290 toward the second-stage regenerator 280 through the second pipe 286 (indicated by an arrow FL2 in FIG. 1).

As a result, a DC flow from the second-stage regenerator 280 toward the second-stage pulse tube 290 is locally generated in the first flow rate controller 300. With this, a DC flow from, the low-temperature end 294 toward the high-temperature end 292 (indicated by an arrow FL3 in FIG. 1) is formed in the second-stage pulse tube 290.

Accordingly, a high-temperature refrigerant gas on the high-temperature end 292 side is prevented from flowing toward the low-temperature end 294 side as a DC flow, so that it is possible to have a good temperature distribution inside the second-stage pulse tube 290. Therefore, it is possible to improve the cooling efficiency of the pulse tube refrigerator 200.

Next, a description is given of a variation of the above-described pulse tube refrigerator 200.

Figure 3:
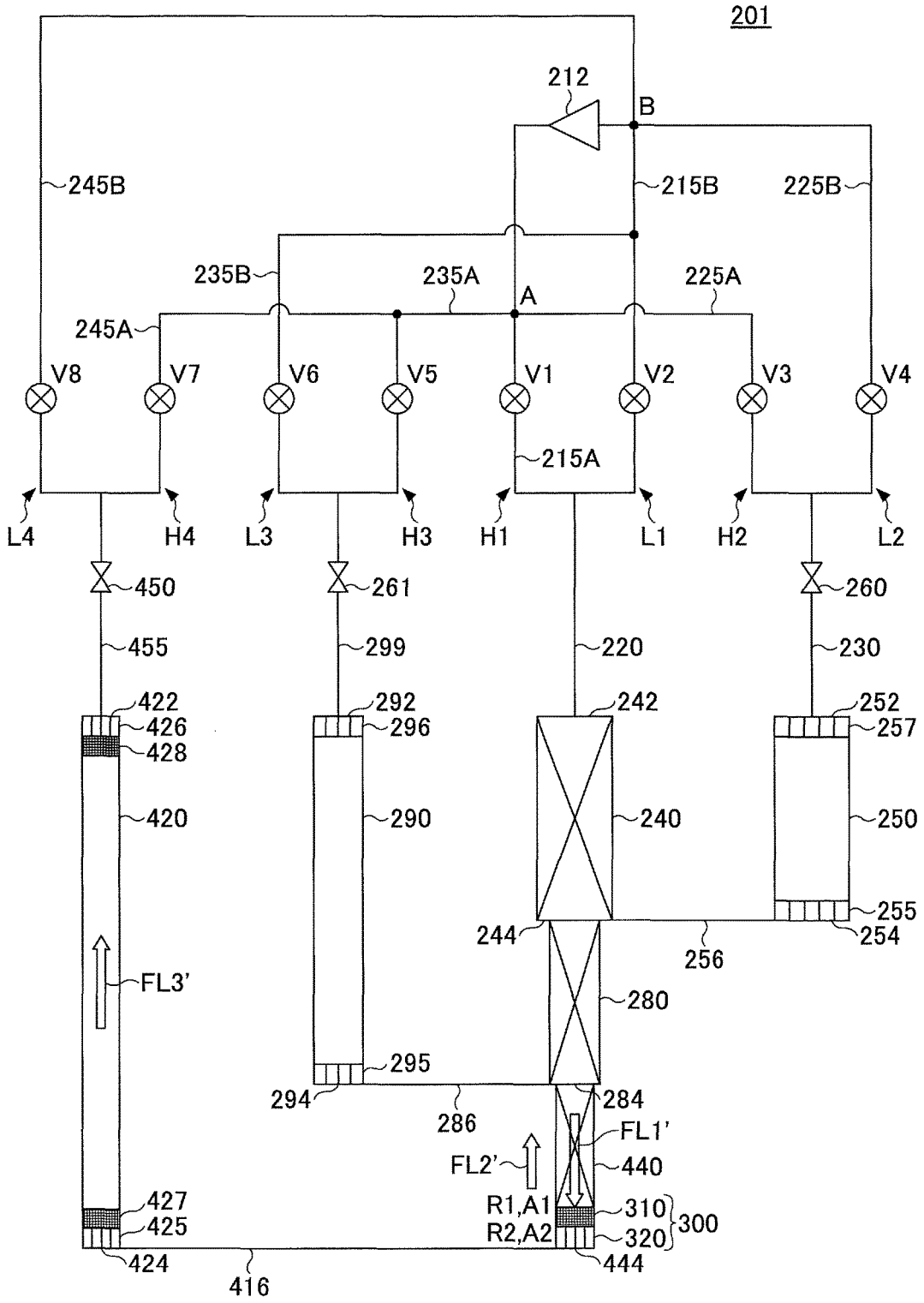
FIG. 3 is a schematic diagram illustrating a configuration of a pulse tube refrigerator that is a variation of the embodiment of the present invention.

FIG. 3 illustrates a pulse tube refrigerator 201, which is a variation of the pulse tube refrigerator 200 illustrated in FIG. 1. While a two-stage pulse tube refrigerator is illustrated in the above-described embodiment, regenerators are connected in series for three stages into a three-stage pulse tube refrigerator in this variation.

In FIG. 3, elements corresponding to those of the pulse tube refrigerator 200 according to the embodiment illustrated in FIG. 1 are referred to by the same reference characters, and their description is omitted.

In addition to the configuration of the above-described two-stage pulse tube refrigerator 200, the three-stage pulse tube refrigerator 201 includes a third-stage regenerator 440 and a third-stage pulse tube 420.

A high-temperature-side heat exchanger 426 and a high-temperature-side flow smoother 423 are provided at a high-temperature end 422 of the third-stage pulse tube 420. Furthermore, a low-temperature-side heat exchanger 425 and a low-temperature-side flow smoother 427 are provided at a low-temperature end 424 of the third-stage pulse tube 420. Furthermore, a low-temperature end 444 of the third-stage regenerator 440 is connected to the low-temperature end 424 of the third-stage pulse tube 420 through a third pipe 416.

The refrigerant channel on the high-pressure side (discharge side) of the compressor 212 includes a fourth refrigerant supply channel H4 in addition to the first through third refrigerant supply channels H1 through H3. Furthermore, the refrigerant channel on the low-pressure side (suction side) of the compressor 212 includes a fourth refrigerant return channel L4 in addition to the first through third, refrigerant return channels L1 through L3.

The fourth refrigerant supply channel H4 extends from the high-pressure side of the compressor 212 to the third-stage pulse tube 420 via a fourth high-pressure-side pipe 245A, provided with an opening and closing valve V7, and a common pipe 455, provided with a channel resistance 450. Furthermore, the fourth refrigerant return channel L4 is formed of a channel extending from the third-stage pulse tube 420 to the compressor 212 via the common pipe 455, provided with the channel resistance 450, a fourth low-pressure-side pipe 245B, provided with an opening and closing valve V8, and the point B. Furthermore, the channel resistance 450 includes an orifice.

In the pulse tube refrigerator 201 as well, the first flow rate controller 300 is provided on the low-temperature side of a regenerator at a final stage among multiple regenerators, that is, the third-stage regenerator 440. Therefore, in this variation as well, the flow rate of a flow FL1' flowing from the third-stage regenerator 440 toward the third-stage pulse tube 420 is greater than the flow rate of a flow FL2' flowing from the third-stage pulse tube 420 toward the third-stage regenerator 440. As a result, a DC flow from the third-stage regenerator 440 toward the third-stage pulse tube 420 is formed, with which a DC flow FL3' toward the high-temperature end 422 from the low-temperature end 424 is formed in the third-stage pulse tube 420.

Accordingly, in this variation as well, it is possible to have a good temperature distribution inside the third-stage pulse tube 420, so that it is possible to improve the cooling efficiency of the pulse tube refrigerator 201.

Next, a description is given of another embodiment of the present invention.

Figure 4:
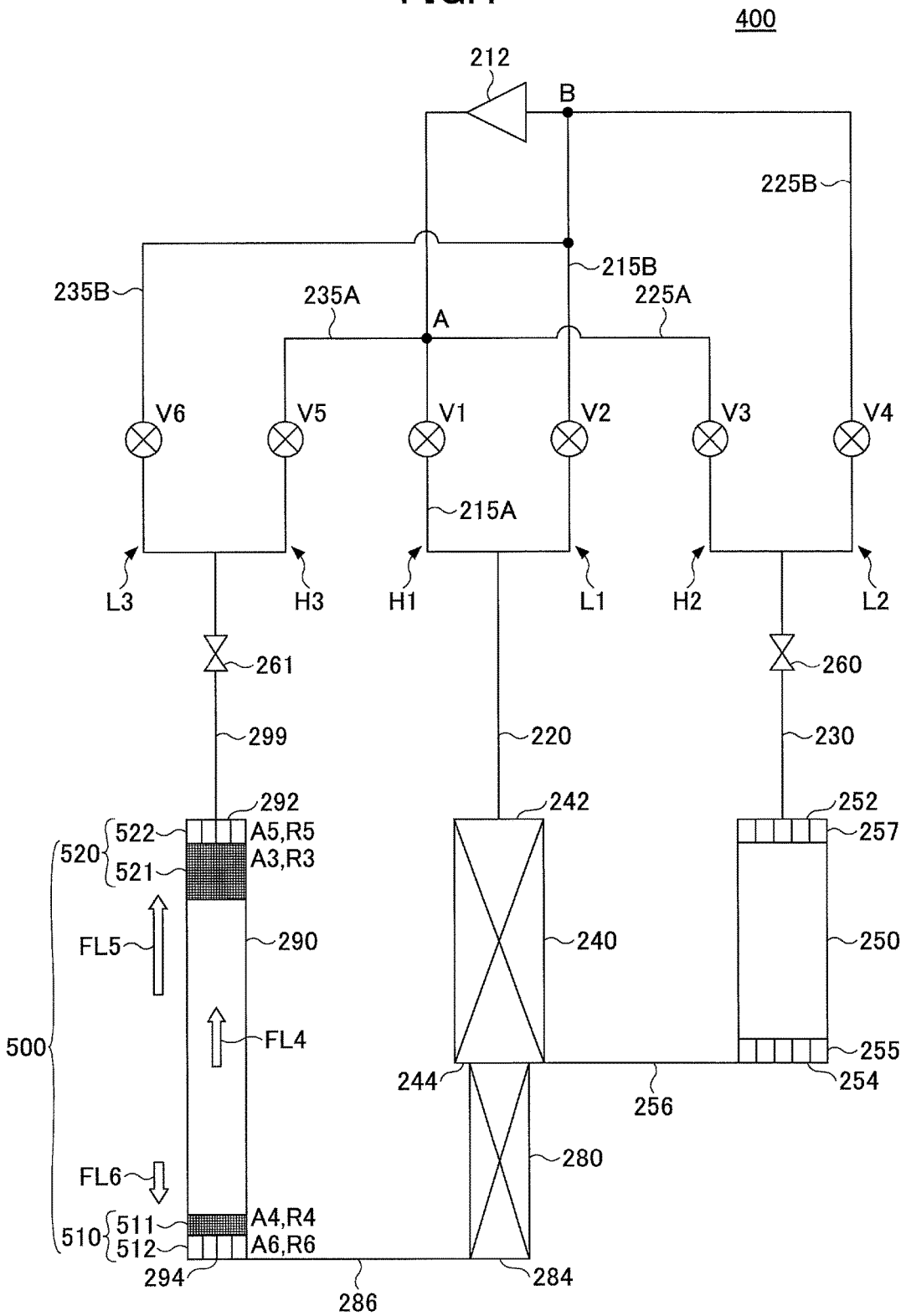
FIG. 4 is a schematic diagram illustrating a configuration of a pulse tube refrigerator that is another embodiment of the present invention.

FIG. 4 illustrates a pulse tube refrigerator 400, which is another embodiment of the present invention. The pulse tube refrigerator 400 according to this embodiment has the same configuration as the pulse tube refrigerator 200 according to the embodiment illustrated in FIG. 1 except for the structure of the second-stage regenerator 280 and the structure of the second-stage pulse tube 290. Therefore, in the following description, a description is given of the structure of the second-stage regenerator 280 and the structure of the second-stage pulse tube 290 in this embodiment, and a description, of other configurations is omitted. In FIG. 4 as well, elements corresponding to those of the pulse tube refrigerator 200 according to the embodiment illustrated in FIG. 1 are referred to by the same reference characters.

In the pulse tube refrigerator 400 according to this embodiment, unlike in the pulse tube refrigerator 200 according to the above-described embodiment, the first flow rate controller 300 is not provided, in the second-stage regenerator 280. In the pulse tube refrigerator 400 according to this embodiment, however, a second flow rate controller 500 is provided in the second-stage pulse tube 290.

The second flow rate controller 500 includes a low-temperature-side flow controller 510 provided at the low-temperature end 294 of the second-stage pulse tube 290 and a high-temperature-side flow rate controller 520 provided at the high-temperature end 292 of the second-stage pulse tube 290. The low-temperature-side flow controller 510 includes a low-temperature-side flow smoother 511 and a low-temperature-side heat exchanger 512. The high-temperature-side flow rate controller 520 includes a high-temperature-side flow smoother 521 and a high-temperature-side heat exchanger 522.

Each of the low-temperature-side flow smoother 511, the high-temperature-side flow smoother 521, the low-temperature-side heat exchanger 512, and the high-temperature-side heat exchanger 522 includes multiple mesh members stacked, in layers. Furthermore, the low-temperature-side heat exchanger 512 and the high-temperature-sloe heat exchanger 522 are formed of copper in order to increase heat exchangeability. On the other hand, the low-temperature-side flow smoother 511 and the high-temperature-side flow smoother 521 are formed of a material other than copper (for example, stainless steel).

In this embodiment, the low-temperature-side neat exchanger 512 and the high-temperature-side heat exchanger 522 have the same configuration. Therefore, the low-temperature-side heat exchanger 512 and the high-temperature-side heat exchanger 522 have the same aperture ratio and the same channel resistance per unit length.

On the other hand, an aperture ratio A3 of the high-temperature-side flow smoother 521 formed of mesh members (the ratio of the area of openings through which a refrigerant gas flows to the area of the high-temperature-side flow smoother 521 in a plan view) is smaller than an aperture ratio A4 of the low-temperature-side flow smoother 511 (the ratio of the area of openings through which a refrigerant gas flows to the area of the low-tempera temperature-side flow smoother 511 in a plan view) (A3<A4).

Specifically, while the high-temperature-side flow smoother 521 uses a fine mesh member of 250 to 400 mesh, the low-temperature-side flow smoother 511 uses a relatively coarse mesh member of 100 to 250 mesh. The high-temperature-side heat exchanger 522 and the low-temperature-side heat exchanger 512 use coarse mesh members of 10 to 100 mesh.

As a result of configuring the second flow rate controller 500 as described above, a channel resistance per unit length R3 of the high-temperature-side flow smoother 521 is greater than a channel resistance per unit length R5 of the high-temperature-side heat exchanger 522 (R3>R5). In the case of connecting two channels that are different in channel resistance, a refrigerant gas is less likely to flow from the side of a smaller channel resistance to the side of a greater channel resistance. Therefore, with an oscillatory flow of the refrigerant gas, a DC flow in the direction of the side of a greater channel resistance to the side of a smaller channel resistance is locally generated. The channel resistance R3 of the high-temperature-side flow smoother 521 is greater than the channel resistance R5 of the high-temperature-side heat exchanger 522 (R3>R5). Accordingly, a local DC flow flowing from the low-temperature side toward the high-temperature side of the second-stage pulse tube 290 (indicated by an arrow FL 5 in FIG. 4) is generated on the high-temperature side in the second-stage pulse tube 290.

On the other hand, a channel resistance per unit length R4 of the low-temperature-side flow smoother 511 is greater than a channel resistance per unit length R6 of the high-temperature-side heat exchanger 512 (R4>R6). In the case of connecting the interfaces of two channels that are different in channel resistance, a refrigerant gas is less likely to flow from the side of a smaller channel resistance to the side of a greater channel resistance. Therefore, with an oscillatory flow of the refrigerant gas, a DC flow in the direction of the side of a greater channel resistance to the side of a smaller channel resistance is locally generated. The channel resistance R4 of the low-temperature-side flow smoother 511 is greater than the channel resistance R6 of the low-temperature-side heat exchanger 512 (R4>R6). Accordingly, a local DC flow flowing from the high-temperature side toward the low-temperature side of the second-stage pulse tube 290 (indicated by an arrow FL 6 in FIG. 4) is generated on the low-temperature side in the second-stage pulse tube 290.

The channel resistance R3 of the high-temperature-side flow smoother 521 of the second flow rate controller 500 is greater than the channel resistance R4 of the low-temperature-side flow smoother 511 of the second flow rats controller 500 (R3>R4). Accordingly, the DC flow FL5 generated on the high-temperature side is greater than the DC flow FL6 generated on the low-temperature side (FL5>FL6). Therefore, a DC flow flowing from the low-temperature end 294 toward the high-temperature end 292 (indicated by an arrow FL4 in FIG. 4) is generated in the second-stage pulse tube 290 as a whole.

As a result, a high-temperature refrigerant gas on the high-temperature end 292 side is prevented from flowing toward the low-temperature end 294 side as a DC flow, so that it is possible to have a good temperature distribution inside the second-stage pulse tube 290. Therefore, if is possible to improve the cooling efficiency of the pulse tube refrigerator 400.

Next, a description is given of a variation of the above-described pulse tube refrigerator 400.

Figure 5:
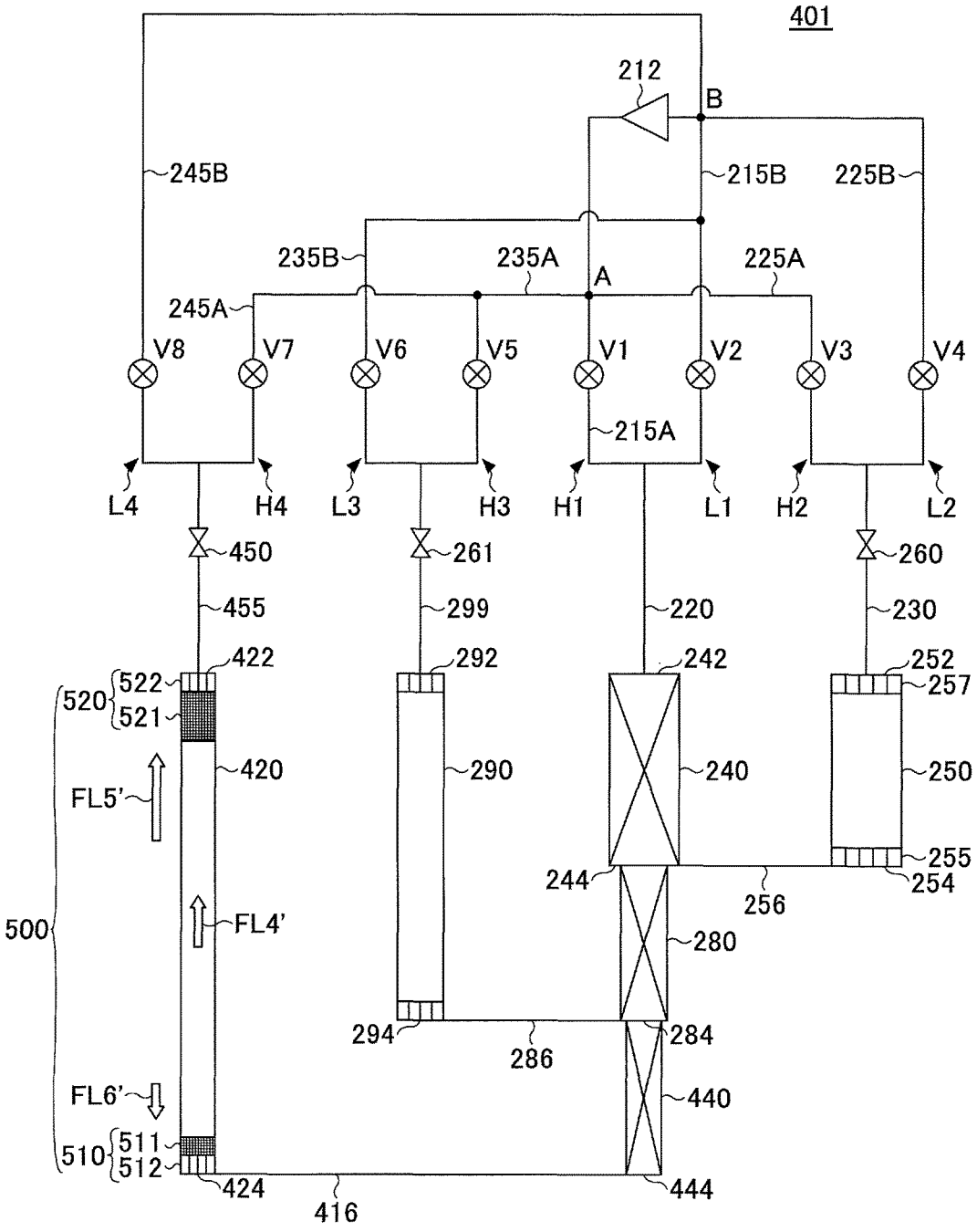
FIG. 5 is a schematic diagram illustrating a configuration of a pulse tube refrigerator that is a variation of the other embodiment of the present invention.

FIG. 5 illustrates a pulse tube refrigerator 401, which is a variation of the pulse tube refrigerator 400 illustrated in FIG.

4. While a two-stage pulse tube refrigerator is illustrated as the above-described pulse tube refrigerator 400, regenerators are connected in series for three stages into a three-stage pulse tube refrigerator in this variation.

In FIG. 5, elements corresponding to those of the pulse tube refrigerators 200, 201 and 400 according to the embodiments and variation illustrated, in FIG. 1 through FIG. 4 are referred to by the same reference characters, and their description is omitted.

In the pulse tube refrigerator 401 illustrated, in FIG. 5 as well, the second flow rate controller 500 is provided in a pulse tube at a final stage among multiple pulse tubes, that is, the third-stage pulse tube 420. Therefore, in this variation as well, the flow rate of a flow in the direction of the low-temperature end 424 to the high-temperature end 422 (indicated by an arrow FL5' in FIG. 5) is greater than the flow rate of a flow in the direction of the high-temperature end 422 to the low-temperature end 424 (indicated by an arrow FL6' in FIG. 5) in the third-stage pulse tube 420 as a whole. As a result, a DC flow in the direction of the low-temperature end 424 to the high-temperature end 422 (indicated by an arrow FL4') is formed in the third-stage pulse tube 420 as a whole.

As a result, in this variation as well, a high-temperature refrigerant gas on the high-temperature end 422 side is prevented from flowing toward the low-temperature end 424 side as a DC flow, so that it is possible to have a good temperature distribution inside the third-stage pulse tube 420. Therefore, it is possible to improve the cooling efficiency of the pulse tube refrigerator 401.

In the above-described pulse tube refrigerators 400 and 401, the flow rate controller 300 is not provided in the second-stage regenerator 280 or the third-stage regenerator 440. Alternatively, both the first flow rate controller 300 and the second flow rate controller 500 may be provided in a single pulse tube refrigerator.

All examples and conditional language provided herein are intended for pedagogical purposes of aiding the reader in understanding the invention and the concepts contributed by the inventors to further the art, and are not to be construed as limitations to such specifically recited examples and conditions, nor does the organisation of such examples in the specification relate to a showing of the superiority or inferiority of the invention. Although one or more embodiments of the present invention have been described in detail, it should be understood that the various changes, substitutions, and alterations could be made hereto without departing from the spirit and scope of the invention.

For example, in the embodiment illustrated in FIG. 4 and its variation illustrated in FIG. 5, the channel resistance per unit length R3 of the high-temperature-side flow smoother 521 is greater than the channel resistance per unit length R4 of the low-temperature-side flow smoother 521 (R3>R4). Alternatively, the channel resistances R3 and R4 of the high-temperature-side flow smoother 521 and the low-temperature-side flow smoother 521 may be equal and the channel resistance per unit length R5 (FIG. 4) of the high-temperature-side heat exchanger 522 may be smaller than the channel resistance per unit length R6 (FIG. 4) of the low-temperature-side heat exchanger 512 (R5<R6). Specifically, an aperture ratio A6 of the low-temperature-side heat exchanger 512 formed of mesh members may be smaller than an aperture ratio A5 of the high-temperature-side heat exchanger 522.

What is claimed is:

1. A pulse tube refrigerator, comprising:

a compressor;

a regenerator to which a refrigerant gas is discharged from the compressor and from which the refrigerant gas returns to the compressor;

a pulse tube including a low-temperature end connected to a low-temperature end of the regenerator;

a flow rate controller provided at the low-temperature end of the regenerator and including a heat exchanger including a first mesh member; and a flow smoother including a second mesh member and having an aperture ratio smaller than an aperture ratio of the heat exchanger, wherein the flow rate controller is configured to control a flow rate of a first DC flow flowing from the regenerator toward the pulse tube and a flow rate of a second DC flow flowing from the pulse tube toward the regenerator, so that the flow rate of the first DC flow is greater than the flow rate of the second DC flow, and wherein the flow smoother having the smaller aperture ratio is provided on an upstream side of the heat exchanger in a direction of the first DC flow;

a low-temperature-side heat exchanger and a low-temperature-side flow smoother that are provided at the low-temperature end of the pulse tube, the low-temperature-side flow smoother provided on an upstream side of the low-temperature-side heat exchanger in a direction of the second DC flow, and having an aperture ratio smaller than an aperture ratio of the low-temperature-side heat exchanger; and an additional regenerator having a low-temperature end connected to the high-temperature end of the regenerator, wherein the refrigerant gas is discharged from the compressor to the regenerator through the additional regenerator.

2. The pulse tube refrigerator as claimed in claim 1, wherein the heat exchanger includes the first mesh member of 10 to 100 mesh, and the flow smoother includes the second mesh member of 150 to 400 mesh.

3. The pulse tube refrigerator as claimed in claim 1, wherein the heat exchanger is formed of copper, and the flow smoother is formed of a material different from copper.

4. The pulse tube refrigerator as claimed in claim 1, further comprising:

an additional flow rate controller provided in the pulse tube, wherein the additional flow rate controller is configured to control a flow rate of a third DC flow flowing from the low-temperature end of the pulse tube toward a high-temperature end of the pulse tube and a flow rate of a fourth DC flow flowing from the high-temperature end of the pulse tube toward the low-temperature end of the pulse tube, so that the flow rate of the third DC flow is greater than the flow rate of the fourth DC flow.

5. The pulse tube refrigerator as claimed in claim 1, further comprising:

a high-temperature-side flow smoother provided at a high-temperature end of the pulse tube, wherein an aperture ratio of the high-temperature-side flow smoother is smaller than the aperture ratio of the low-temperature-side flow smoother.

6. The pulse tube refrigerator as claimed in claim 1, further comprising:

a high-temperature-side heat exchanger provided at a high-temperature end of the pulse tube, wherein the aperture ratio of the low-temperature-side heat exchanger is smaller than an aperture ratio of the high-temperature-side heat exchanger.

7. The pulse tube refrigerator as claimed in claim 4, wherein each of the pulse tube and the regenerator is provided in multiple stages, and the additional flow rate controller is provided in the pulse tube at a final one of the multiple stages.

8. A pulse tube refrigerator, comprising:

a compressor;

a regenerator to which a refrigerant gas is discharged from the compressor and from which the refrigerant gas returns to the compressor;

a pulse tube including a low-temperature end connected to a low-temperature end of the regenerator, and a high-temperature end opposite to the low-temperature end;

a first flow rate controller provided in the pulse tube at the low-temperature end thereof, and including a first heat exchanger and a first flow smoother; and a second flow rate controller provided in the pulse tube at the high-temperature end thereof, and including a second heat exchanger and a second flow smoother, wherein the second flow smoother has an aperture ratio smaller than an aperture ratio of the first flow smoother, wherein a difference between a mesh number of the second flow smoother and a mesh number of the second heat exchanger is greater than a difference between a mesh number of the first flow smoother and a mesh number of the first heat exchanger, and wherein the first and second flow rate controllers are configured to control a flow rate of a first DC flow flowing from the low-temperature end of the pulse tube toward the high-temperature end of the pulse tube and a flow rate of a second DC flow flowing from the high-temperature end of the pulse tube toward the low-temperature end of the pulse tube, so that the flow rate of the first DC flow is greater than the flow rate of the second DC flow.

9. The pulse tube refrigerator as claimed in claim 1, wherein the heat exchanger includes a plurality of mesh members that are stacked in layers, the plurality of mesh members being formed of copper and including the first mesh member, and the flow smoother includes a plurality of mesh members that are stacked in layers, the plurality of mesh members of the flow smoother being formed of a material different from copper, and including the second mesh member.

* * * * *